US010449775B2

(12) United States Patent
Akahane

(10) Patent No.: US 10,449,775 B2
(45) Date of Patent: Oct. 22, 2019

(54) LIQUID EJECTING HEAD AND FILTER UNIT

(71) Applicant: SEIKO EPSON CORPORATION, Tokyo (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/029,802

(22) Filed: Jul. 9, 2018

(65) Prior Publication Data

US 2019/0016148 A1 Jan. 17, 2019

(30) Foreign Application Priority Data

Jul. 11, 2017 (JP) ..... 2017-135308

(51) Int. Cl.
*B41J 2/175* (2006.01)

(52) U.S. Cl.
CPC ..... *B41J 2/17563* (2013.01); *B41J 2/17509* (2013.01)

(58) Field of Classification Search
CPC ..... B41J 2/17563; B41J 2/17509
See application file for complete search history.

(56) References Cited

FOREIGN PATENT DOCUMENTS

| | | | |
|---|---|---|---|
| JP | 2992754 B | | 10/1999 |
| JP | 3757781 B | | 1/2006 |
| JP | 2013-56480 A | | 3/2013 |
| JP | 2013056480 A | * | 3/2013 |

* cited by examiner

*Primary Examiner* — Bradley W Thies
(74) *Attorney, Agent, or Firm* — Workman Nydegger

(57) ABSTRACT

A filter unit provided in a path for supplying liquid to a liquid ejector includes: an upstream compartment into which the liquid flows from an upstream channel; a downstream compartment from which the liquid flows into a downstream channel; and a filter that serves as a partition between the upstream compartment and the downstream compartment. The upstream compartment overlaps the downstream compartment in a first direction intersecting the vertical direction. The downstream compartment has at least one first downstream opening and at least one second downstream opening in communication with the downstream channel. The second downstream opening is disposed below the first downstream opening in the vertical direction.

14 Claims, 6 Drawing Sheets

LIQUID EJECTING HEAD AND FILTER UNIT

BACKGROUND

1. Technical Field

The present invention relates to a technique of ejecting liquid, such as ink.

2. Related Art

A typical liquid ejecting head that ejects liquid from nozzles is equipped with a filter unit at an intermediate position in the path of the liquid. The filter unit includes a filter for removing bubbles and contaminants from the liquid. For example, JP-A-2013-56480 discloses a filter unit including an upstream compartment (first compartment) provided with an upstream opening, a downstream compartment (second compartment) provided with a downstream opening, and a filter serving as a partition between the upstream and downstream compartments. The downstream opening is disposed above the downstream compartment in the vertical direction.

SUMMARY

Bubbles that have entered the filter unit rise due to buoyancy and sometimes remain in the upper portion of the filter unit. Undesirably, in the filter unit disclosed in JP-A-2013-56480 provided with a single downstream opening disposed above the downstream compartment in the vertical direction, such remaining bubbles may move to the downstream compartment and block the downstream opening or a downstream channel in communication with the downstream opening. The bubbles inhibit liquid from being supplied to the liquid ejecting head, resulting in insufficient liquid supply to the liquid ejecting head. An advantage of some aspects of the invention is to reduce the inhibition of liquid supply caused by such remaining bubbles.

A filter unit according to a first aspect of the invention, which is provided in a path for supplying liquid to a liquid ejector, includes: an upstream compartment into which the liquid flows from an upstream channel; a downstream compartment from which the liquid flows into a downstream channel; and a filter that serves as a partition between the upstream compartment and the downstream compartment. The upstream compartment overlaps the downstream compartment in a first direction intersecting the vertical direction. The downstream compartment has at least one first downstream opening and at least one second downstream opening in communication with the downstream channel. The second downstream opening is disposed below the first downstream opening in the vertical direction. This configuration enables the liquid to exit the downstream compartment through the second downstream opening disposed below the first downstream opening, even if bubbles that have entered from the upstream channel rise and remain in the vicinity of the first downstream opening and inhibit the liquid from exiting the downstream compartment through the first downstream opening. The configuration can thus enable sufficient liquid to be supplied to the liquid ejector, that is, the configuration can reduce the inhibition of liquid supply caused by remaining bubbles.

It is preferable that the at least one first downstream opening have a channel resistance lower than that of the at least one second downstream opening. Because the channel resistance of the first downstream opening is lower than that of the second downstream opening, remaining bubbles are discharged with a flow of liquid to the downstream channel leading to the liquid ejector through the first downstream opening more readily than through the second downstream opening. This configuration can improve the efficiency of discharging bubbles and thus reduce the consumption of liquid for discharging the bubbles.

It is preferable that the at least one first downstream opening adjoin the inner top surface of the downstream compartment. The first downstream opening, which adjoins the inner top surface of the downstream compartment, can suppress the liquid from stagnating in the vicinity of the inner top surface of the downstream compartment and can readily enable bubbles remaining around the inner top surface to be discharged.

It is preferable that the upstream compartment have an upstream opening in communication with the upstream channel, that the at least one first downstream opening be disposed above the upstream opening in the vertical direction, and that the at least one second downstream opening be disposed below the upstream opening in the vertical direction. The bubbles that have entered through the upstream opening tend to move to the first downstream opening disposed above the upstream opening due to buoyancy but rarely move to the second downstream opening disposed below the upstream opening. Regardless of bubbles remaining in the vicinity of the first downstream opening, this configuration readily enables liquid to be supplied through the second downstream opening during liquid ejection from the liquid ejector and readily enables the bubbles to be discharged through the first downstream opening during bubble removal.

It is preferable that the at least one first downstream opening have an outline in plan view at least partially overlapping the outline in plan view of the downstream channel. The first downstream opening, which has the outline in plan view at least partially overlapping the outline in plan view of the downstream channel, can readily enable bubbles to be discharged to the downstream channel.

It is preferable that the at least one first downstream opening include a plurality of first downstream openings arranged in a row on the downstream compartment in a second direction intersecting the vertical direction. The first downstream openings, which are arranged on the downstream compartment in the second direction intersecting the vertical direction, can readily enable bubbles distributed in the second direction to be discharged.

It is preferable that the downstream compartment have a rectangular shape, and that at least one of the first downstream openings be disposed adjacent to a corner of the downstream compartment. The rectangular downstream compartment provides the filter with a larger effective area than a downstream compartment having a circular or elliptical shape. Undesirably, the rectangular downstream compartment readily causes liquid to stagnate around the corners of the downstream compartment, resulting in remaining bubbles. At least one of the first downstream openings, which is disposed adjacent to one of the corners of the downstream compartment, can suppress the liquid from stagnating around the corner and readily enable bubbles remaining around the corner to be discharged.

To realize the above advantage, a liquid ejecting head according to a second aspect of the invention includes: the filter unit according to the first aspect; and a liquid ejector that ejects liquid supplied from the filter unit. This configuration can provide the liquid ejecting head including the filter unit that can reduce the inhibition of liquid supply to the liquid ejector caused by remaining bubbles.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
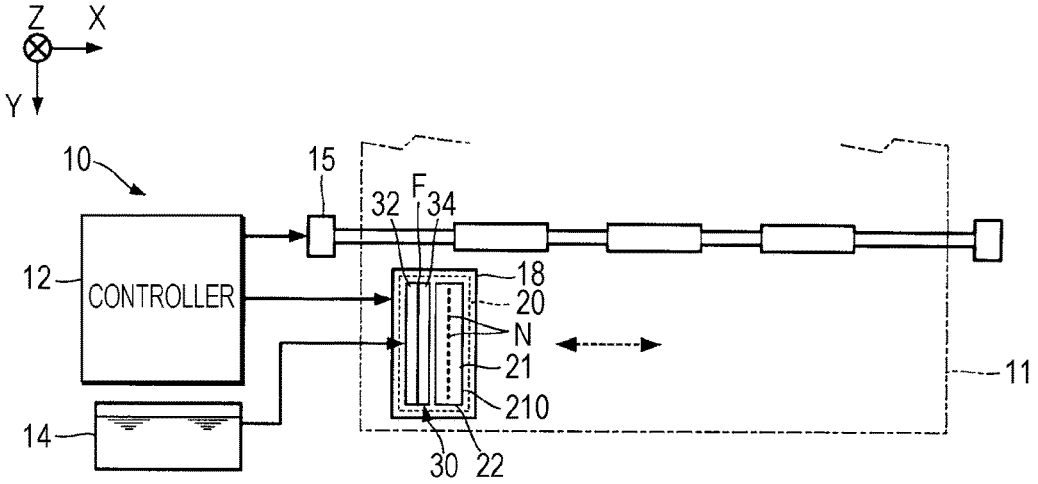
FIG. 1 illustrates the configuration of a liquid ejecting apparatus according to a first embodiment.

FIG. 1 illustrates a partial configuration of a liquid ejecting apparatus 10 according to a first embodiment of the invention. The liquid ejecting apparatus 10 according to the embodiment is an ink jet printer that ejects ink (an exemplary liquid) onto a medium 11, such as a print sheet. The liquid ejecting apparatus 10 illustrated in FIG. 1 includes a controller 12, a transport mechanism 15, a liquid ejecting head 20, and a carriage 18. The liquid ejecting apparatus 10 is provided with a liquid container (cartridge) 14 that stores ink.

The liquid container 14 is an ink tank cartridge having a box shape and is detachably attached to the body of the liquid ejecting apparatus 10. The liquid container 14 may also be an ink pack cartridge having a pouch shape other than the box shape. The liquid container 14 stores ink. The ink may be black ink or color ink. The ink stored in the liquid container 14 is supplied (pumped) to the liquid ejecting head 20 by a pump (not shown).

The controller 12 controls each component of the liquid ejecting apparatus 10. The transport mechanism 15 transports the medium 11 in the Y direction under the control of the controller 12. The liquid ejecting head 20 ejects ink onto the medium 11 from individual nozzles N under the control of the controller 12.

The liquid ejecting head 20 is mounted on the carriage 18. The controller 12 causes the carriage 18 to reciprocate in the X direction, which intersects the Y direction. During a printing operation, in parallel with the transport of the medium 11 by the transport mechanism 15 and with the reciprocation of the carriage 18, the liquid ejecting head 20 ejects ink onto the medium 11 to form a desired image on the surface of the medium 11. Alternatively, two or more liquid ejecting heads 20 that eject mutually different types of ink may be mounted on the carriage 18, for example. It should be noted that the direction orthogonal to the XY plane (parallel to the surface of the medium 11) is defined as the Z direction.

Liquid Ejecting Head

Figure 2:
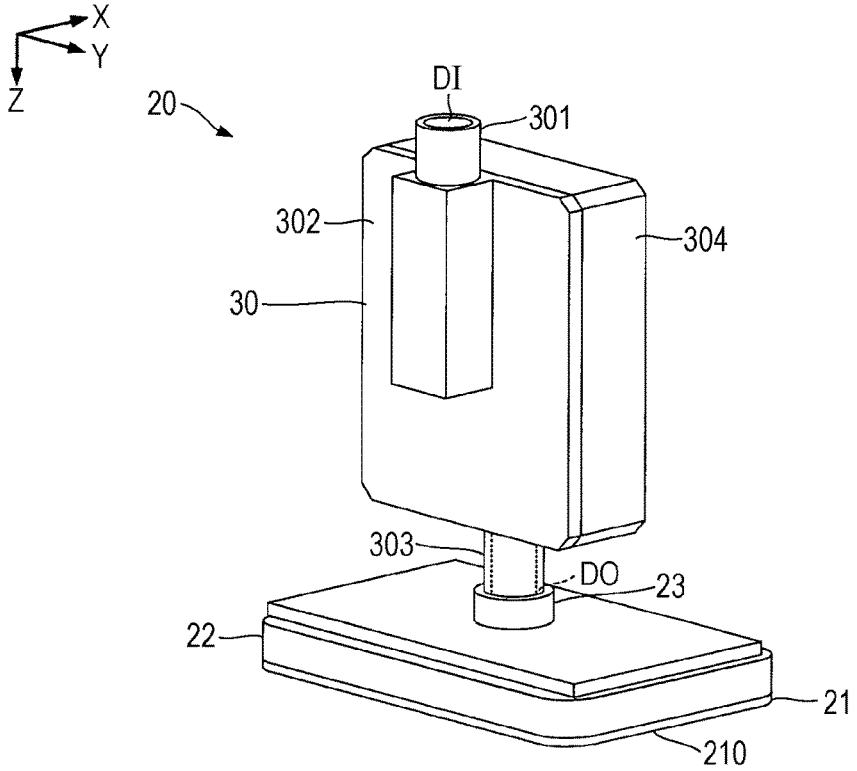
FIG. 2 is an external perspective view of a liquid ejecting head.

FIG. 2 is an external perspective view of the liquid ejecting head 20. The liquid ejecting head 20 includes a liquid ejector 22 and a filter unit 30. The liquid ejector 22 is disposed in the X direction orthogonal to the Y direction (transport direction of the medium 11). The liquid ejector 22 includes a nozzle plate 21 having nozzle arrays thereon. Each of the nozzle arrays is composed of nozzles N arranged in a straight line in the Y direction. The surface of the nozzle plate 21 that faces the medium 11 functions as an ejection surface 210 from which ink is ejected. The number of liquid ejectors 22 and the number of nozzle arrays illustrated in the drawings should not be construed as limiting the invention.

The liquid ejector 22 further includes multiple pairs of a pressure chamber and a piezoelectric element (not shown), which correspond to the respective nozzles N. Each of the piezoelectric elements oscillates in response to a driving signal supplied and thus varies the pressure in the corresponding pressure chamber so that the ink filled in the pressure chamber is ejected from the corresponding nozzle N. The liquid ejector 22 has a joint 23 coupled to the filter unit 30. The joint 23 has an entrance opening (not shown) through which the ink is introduced from the filter unit 30.

The filter unit 30 functions as a filter device including a filter F that collects bubbles and contaminants contained in ink in the path. The filter unit 30 is provided in the path for supplying ink from the liquid container 14. The filter F is disposed in the filter unit 30 so as to partition the filter unit 30 into an upstream compartment 32 and a downstream compartment 34. The filter unit 30 according to the embodiment is disposed in an upright orientation and extends vertically in the direction (Z direction) intersecting the ejection surface 210 of the liquid ejector 22. The ink from the liquid container 14 is supplied to the liquid ejector 22 through the filter F of the filter unit 30.

Specific Exemplary Configuration of Filter Unit

Figure 3:
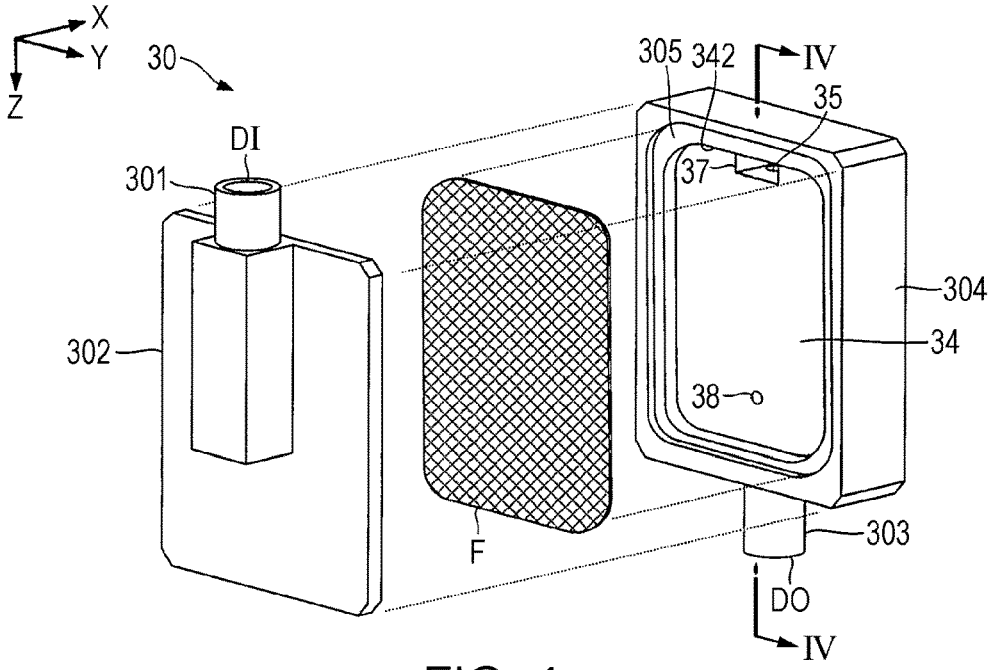
FIG. 3 is an exploded perspective view of a filter unit.
Figure 4:
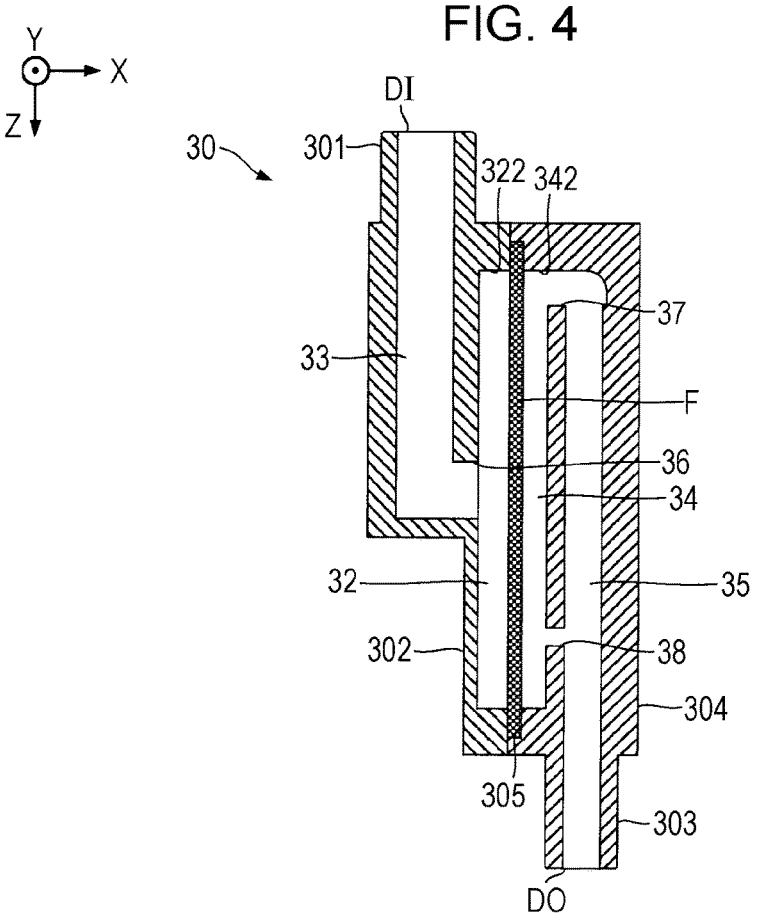
FIG. 4 is a sectional view of the filter unit taken along line IV-IV in FIG. 3.
Figure 5:
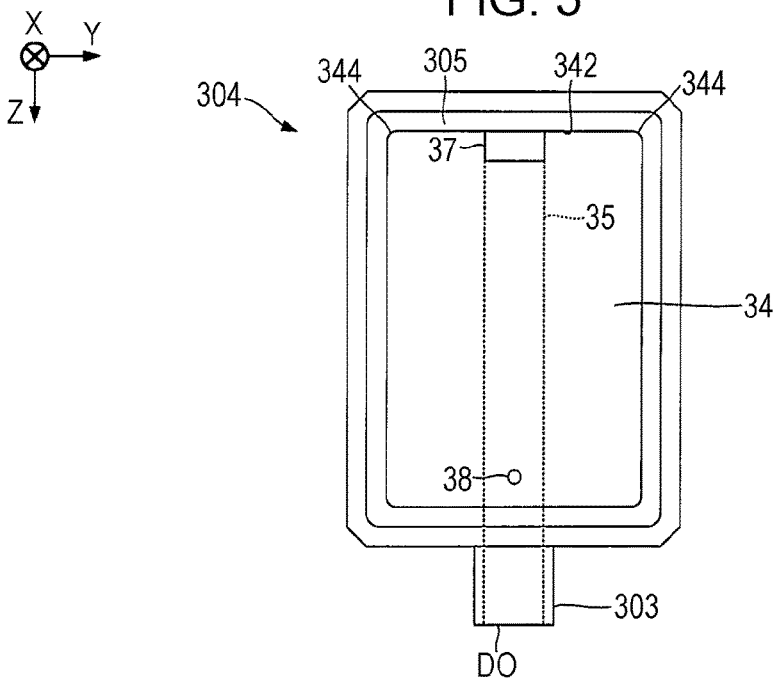
FIG. 5 is a plan view of a downstream member.

FIG. 3 is an exploded perspective view of the filter unit 30. FIG. 4 is a sectional view of the filter unit 30 taken along line IV-IV in FIG. 3. FIG. 5 is a plan view of a downstream member 304 as viewed in the X direction. In FIGS. 3 and 4, the Z direction indicates the vertical direction and the X direction is an exemplary first direction intersecting the vertical direction (the same holds true for the other drawings). With reference to FIGS. 3 and 4, the filter unit 30 includes an upstream member 302, the downstream member 304, and the filter F. The upstream member 302 and the downstream member 304 are coupled to each other and hold the filter F therebetween. The surface of the upstream member 302 that is coupled to the downstream member 304 has a recess defining the upstream compartment 32, while the surface of the downstream member 304 that is coupled to the upstream member 302 has a recess defining the downstream compartment 34.

The coupling of the upstream member 302 and the downstream member 304 causes the upstream compartment 32 and the downstream compartment 34 to overlap each other in the X direction, while the filter F is disposed between the upstream compartment 32 and the downstream compartment 34. Specifically, the downstream member 304 has a circumferential groove 305 to hold the circumferential edge of the filter F. The circumferential groove 305 extends along the circumferential edge of the downstream member 304. The filter F is held between the circumferential groove 305 of the downstream member 304 and the circumferential edge of the upstream member 302 and is thereby fixed between the upstream member 302 and the downstream member 304. The filter F thus functions as a partition between the upstream compartment 32 and the downstream compartment 34.

Although the upstream compartment 32, the downstream compartment 34, and the filter F extend in the vertical direction in the embodiment, this configuration should not be construed as limiting the invention. Alternatively, at least one of the upstream compartment 32, the downstream compartment 34, and the filter F may be inclined from the vertical direction. In the embodiment, the shapes of the upstream member 302 and the downstream member 304 and the shape of the filter F are a rectangle with rounded corners. Alternatively, these shapes may be a rectangle with sharp corners or any other non-rectangular shape, such as a circle or ellipse.

The upstream member 302 is provided with an inlet connector 301 at the top (in the negative Z direction). The inlet connector 301 connects the upstream member 302 to the path leading to the liquid container 14. In contrast, the downstream member 304 is provided with an outlet connector 303 at the bottom (in the positive Z direction). The outlet connector 303 connects the downstream member 304 to the joint 23 of the liquid ejector 22.

The upstream member 302 is further provided with an upstream channel 33. The upstream channel 33 in the embodiment has a tubular shape (for example, a hollow cylindrical shape) and extends in the Z direction. This shape and orientation of the upstream channel 33 in the embodiment should not be construed as limiting the invention. The upstream channel 33 extends through the inlet connector 301. The top end (in the negative Z direction) of the upstream channel 33 defines an inlet DI on the top of the inlet connector 301. An upstream opening 36 that communicates with the upstream compartment 32 is provided at the bottom end (in the positive Z direction) of the upstream channel 33. The upstream opening 36 faces in the positive X direction and is in communication with the substantial center of the upstream compartment 32.

The downstream member 304 is provided with a downstream channel 35. The downstream channel 35 in the embodiment has a tubular shape (for example, a hollow cylindrical shape) and extends in the Z direction. This shape and orientation of the downstream channel 35 in the embodiment should not be construed as limiting the invention. The downstream channel 35 extends through the outlet connector 303. The bottom end (in the positive Z direction) of the downstream channel 35 defines an outlet DO on the bottom of the outlet connector 303. The downstream member 304 has a first downstream opening 37 and a second downstream opening 38 that bring the downstream compartment 34 into communication with the downstream channel 35.

With reference to FIGS. 3 to 5, the first downstream opening 37 adjoins an inner top surface 342 of the downstream compartment 34 and extends in the X direction to the top end (in the negative Z direction) of the downstream channel 35. The second downstream opening 38 is disposed below the first downstream opening 37 in the vertical direction. As illustrated in FIG. 4, the first downstream opening 37 in the embodiment is disposed above the upstream opening 36 in the vertical direction, while the second downstream opening 38 is disposed below the upstream opening 36 in the vertical direction. As illustrated in FIG. 5, The first downstream opening 37 in the embodiment has a rectangular cross section (taken along the YZ plane orthogonal to the X direction), while the second downstream opening 38 has a circular cross section (taken along the YZ plane orthogonal to the X direction). The area of the cross section (taken along the YZ plane) of the first downstream opening 37 in FIG. 5 is larger than the area of the cross section (taken along the YZ plane) of the second downstream opening 38. Accordingly, the first downstream opening 37 has a channel resistance lower than that of the second downstream opening 38.

Figure 6:
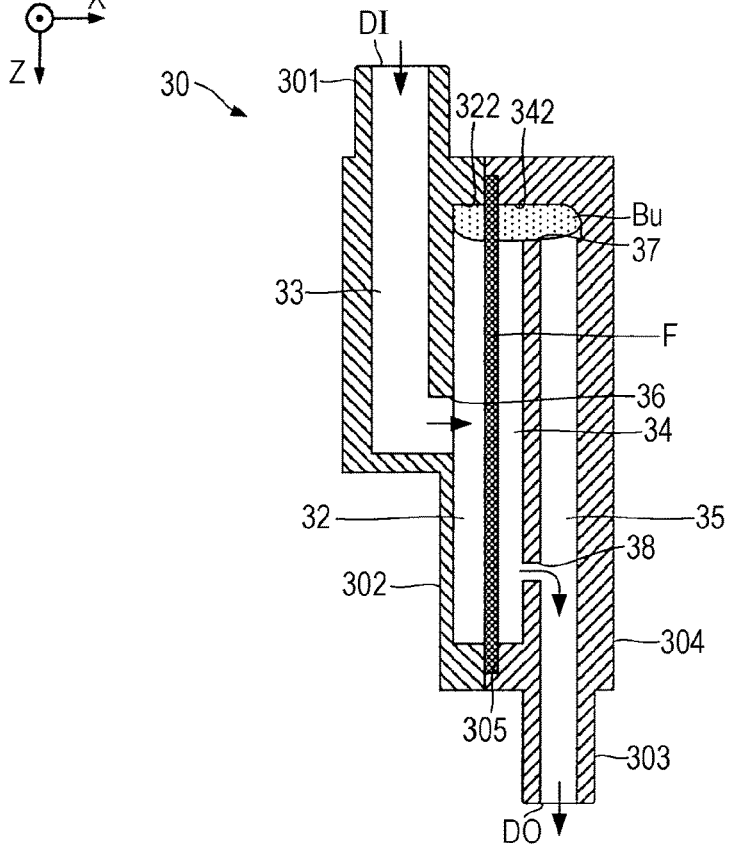
FIG. 6 illustrates a process in the case where bubbles have remained during a printing operation.
Figure 7:
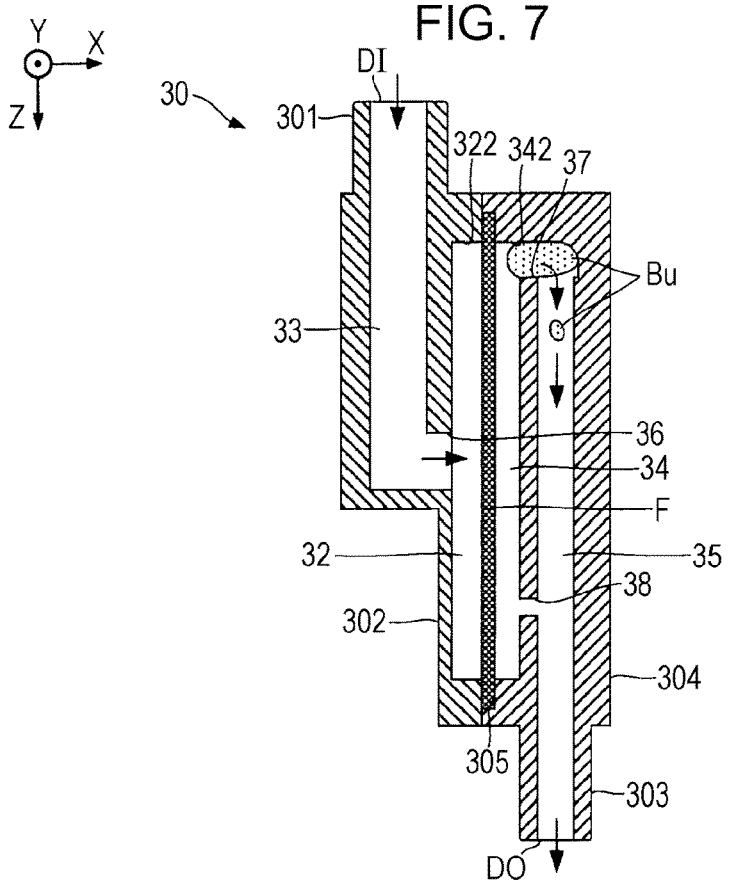
FIG. 7 illustrates a process of discharging remaining bubbles during a cleaning operation.

The operations and effects of the filter unit 30 having this configuration according to the embodiment are explained with reference to the accompanying drawings. FIG. 6 illustrates a process in the case where bubbles Bu remain during a printing operation. FIG. 7 illustrates a process of discharging remaining bubbles Bu during a cleaning operation. During the printing operation, ink is supplied from the liquid container 14 to the liquid ejector 22 through the filter unit 30. In the filter unit 30, the ink enters the upstream compartment 32 through the upstream channel 33, passes through the filter F, and then flows into the downstream compartment 34. If no bubble Bu has entered the filter unit 30, the ink in the downstream compartment 34 flows into the downstream channel 35 through the first downstream opening 37 and the second downstream opening 38 and is then supplied to the liquid ejector 22.

If some bubbles Bu have entered the filter unit 30 through the upstream channel 33, the bubbles Bu rise in the filter unit 30 due to buoyancy and remain around an inner top surface 322 of the upstream compartment 32 and the inner top surface 342 of the downstream compartment 34. Such remaining bubbles Bu in the vicinity of the first downstream opening 37 of the downstream compartment 34, as illustrated in FIG. 6, for example, may inhibit the ink supply to the downstream channel 35 through the first downstream opening 37. If an upper first downstream opening 37 is provided alone without a lower second downstream opening 38, sufficient ink might not be supplied to the liquid ejector 22.

In contrast, according to the embodiment, the second downstream opening 38 is disposed below the first downstream opening 37 and enables ink to be supplied to the downstream channel 35, as indicated by an arrow in FIG. 6, regardless of the bubbles Bu inhibiting the ink supply through the first downstream opening 37. This configuration enables sufficient ink to be supplied to the liquid ejector 22 without being affected by the bubbles Bu remaining in the filter unit 30, that is, the configuration can reduce the inhibition of ink supply caused by the remaining bubbles Bu.

To remove the remaining bubbles Bu during a cleaning operation of the liquid ejecting head 20, for example, the ejection surface 210 of the liquid ejector 22 is capped and then vacuumed to extract ink through the nozzles N. For example, with reference to FIG. 7, the extraction of ink through the nozzles N causes a downward flow of ink in the downstream channel 35. The bubbles Bu are thus discharged with the flow of ink. If a lower second downstream opening 38 is provided alone without an upper first downstream opening 37, this configuration does not readily enable the bubbles Bu remaining in the upper portion to be discharged, thereby requiring a larger consumption of ink for discharging the bubbles Bu.

In contrast, according to the embodiment, because the channel resistance of the first downstream opening 37 is lower than that of the second downstream opening 38, the bubbles Bu are discharged through the first downstream opening 37 more readily than through the second downstream opening 38, as indicated by an arrow in FIG. 7, for example. This configuration can improve the efficiency of discharging the bubbles Bu and thus reduce the consumption of ink for discharging the bubbles Bu.

The first downstream opening 37 in the embodiment, which adjoins the inner top surface 342 of the downstream compartment 34, can suppress ink from stagnating in the vicinity of the inner top surface 342 and readily enables the bubbles Bu remaining around the inner top surface 342 to be discharged. In addition, the first downstream opening 37 is disposed above the upstream opening 36, while the second downstream opening 38 is disposed below the upstream opening 36. The bubbles Bu that have entered through the upstream opening 36 tend to move to the first downstream opening 37 disposed above the upstream opening 36 due to buoyancy but rarely move to the second downstream opening 38 disposed below the upstream opening 36. Regardless of bubbles Bu remaining in the vicinity of the first downstream opening 37, this configuration readily enables ink to be supplied through the second downstream opening 38 during a printing operation without being affected by the remaining bubbles Bu and readily enables the bubbles Bu to be discharged through the first downstream opening 37 during a cleaning operation. The above-described positions of the first downstream opening 37 and the second downstream opening 38 in the vertical direction are mere examples and may be appropriately modified as long as the second downstream opening 38 is disposed below the first downstream opening 37.

With reference to FIG. 5, each of the first downstream opening 37 and the second downstream opening 38 is disposed in the center of the downstream compartment 34 in the Y direction. The outline in plan view (as viewed in the X direction) of the first downstream opening 37 and the outline in plan view (as viewed in the X direction) of the second downstream opening 38 overlap the outline in plan view (as viewed in the X direction) of the downstream channel 35. The outline in plan view of the first downstream opening 37 may entirely or partially overlap the outline in plan view of the downstream channel 35. The outline in plan view of the second downstream opening 38 may entirely or partially overlap the outline in plan view of the downstream channel 35. This configuration readily enables ink to be supplied through the first downstream opening 37 and the second downstream opening 38 to the downstream channel 35 during a printing operation and readily enables bubbles Bu to be discharged through the first downstream opening 37 to the downstream channel 35 during a cleaning operation.

Second Embodiment

A second embodiment of the invention is described. In the following embodiments, components having operations and functions identical to those of the components in the first embodiment are provided with the same reference characters as in the first embodiment and description thereof is omitted, as appropriate. Although a single first downstream opening 37 is exemplified in the first embodiment, two or more first downstream openings 37 are exemplified in the second embodiment.

Figure 8:
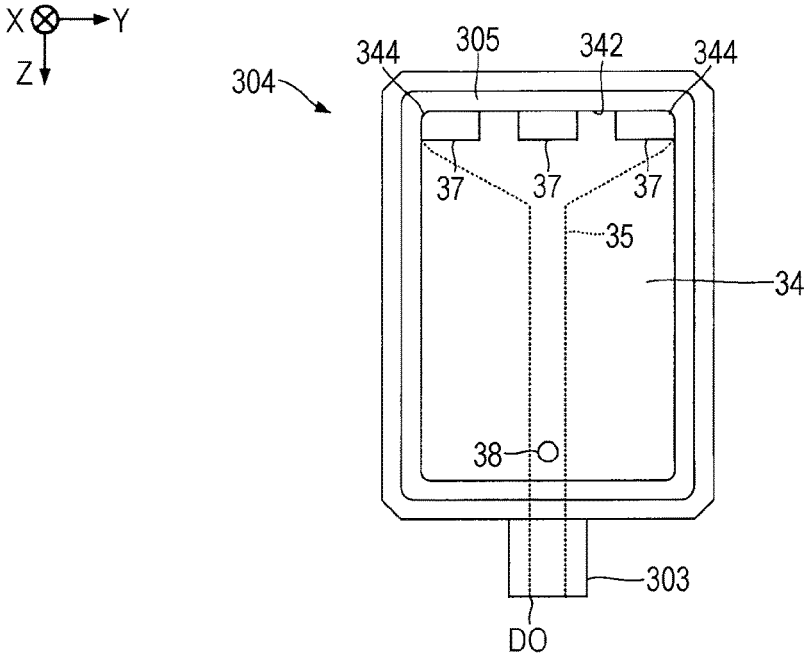
FIG. 8 is a plan view of a downstream member according to a second embodiment.

FIG. 8 is a plan view of the downstream member 304 according to the second embodiment as viewed in the X direction. With reference to FIG. 8, the downstream compartment 34 has three first downstream openings 37. The three first downstream openings 37 are arranged in the Y direction (exemplary second direction). This arrangement readily enables remaining bubbles Bu distributed in the second direction to be discharged through the three first downstream openings 37. The number of first downstream openings 37 is not limited to three and may be two or four or more. As the number of first downstream openings 37 increases, the total cross-sectional area of the first downstream openings 37 increases, while the channel resistance of the first downstream openings 37 decreases. The bubbles Bu are thus more readily discharged.

In the downstream compartment 34 having a rectangular shape, as illustrated in FIG. 8, it is preferable that at least one of the first downstream openings 37 be disposed adjacent to a corner 344 of the downstream compartment 34. In FIG. 8, one first downstream opening 37 is disposed adjacent to the center of the inner top surface 342 in the Y direction, while the other first downstream openings 37 are disposed adjacent to two respective corners 344 (in the positive and negative Y directions). The rectangular downstream compartment 34 in FIG. 8 provides the filter F with a larger effective area than a downstream compartment having a circular or elliptical shape. Undesirably, the rectangular downstream compartment 34 readily causes ink to stagnate around the corners 344, resulting in remaining bubbles. The first downstream openings 37 disposed adjacent to the two respective corners 344, as illustrated in FIG. 8, can suppress ink from stagnating around the corners 344 and readily enable bubbles remaining around the corners 344 to be discharged.

As indicated by the dotted lines in FIG. 8, a part of the downstream channel 35 may have a wider area in the Y direction, such that the outlines in plan view of the first downstream openings 37 overlap the outline in plan view of the downstream channel 35. That is, the outlines in plan view of two or more first downstream openings 37 arranged in the Y direction can also overlap at least part of the outline in plan view of the downstream channel 35. This configuration readily enables bubbles to be discharged through the first downstream openings 37 to the downstream channel 35 during a cleaning operation.

Figure 9:
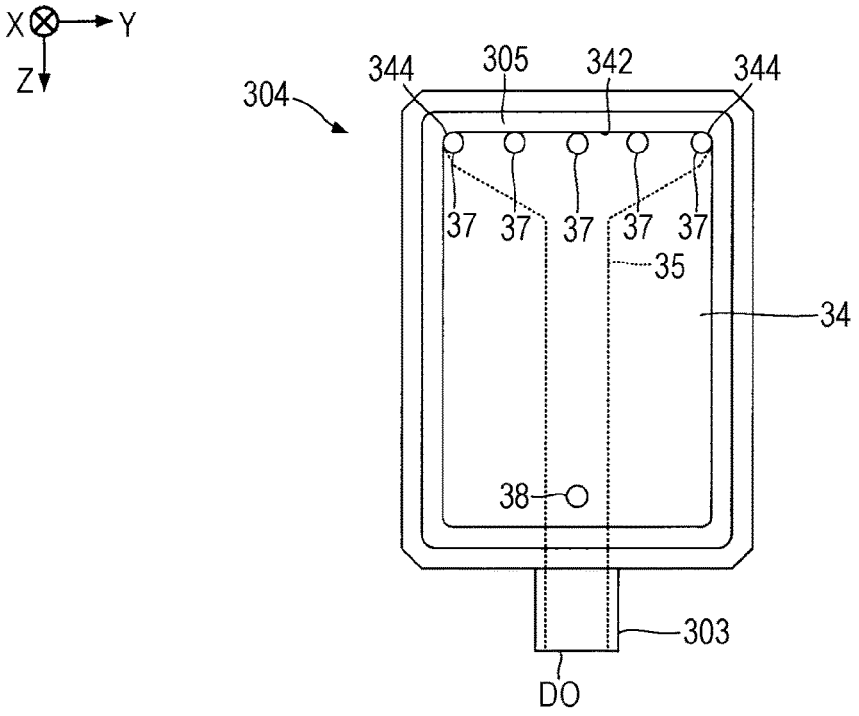
FIG. 9 is a plan view of a downstream member according to a modification of the second embodiment.

Although the first downstream openings 37 and the second downstream opening 38 have different shapes in FIG. 8, the first downstream openings 37 and the second downstream opening 38 may have the same shape. For example, according to a modification of the second embodiment in FIG. 9, the downstream member 304 has the first downstream openings 37 and the second downstream opening 38 having the same shape and different numbers. With reference to FIG. 9, the number of first downstream openings 37 is five, while the number of second downstream opening 38 is one. Since there are more of the first downstream openings 37 than the second downstream opening 38, the total cross-sectional area of the first downstream openings 37 is larger than the cross-sectional area of the second downstream opening 38, despite the first downstream openings 37 and the second downstream opening 38 having the same shape. This configuration can make the channel resistance of the first downstream openings 37 lower than that of the second downstream opening 38 and can thus cause discharge of bubbles Bu through the first downstream openings 37 more readily than through the second downstream opening 38. In the downstream compartment 34 in FIG. 9, two first downstream openings 37 are disposed adjacent to the two respective corners 344 of the inner top surface 342, as in the example illustrated in FIG. 8. This arrangement can suppress ink from stagnating around the corners 344 and readily enable bubbles remaining around the corners 344 to be discharged through the first downstream openings 37. In addition, a part of the downstream channel 35 in FIG. 9 may have a wider area in the Y direction, such that the outlines in plan view of the first downstream openings 37 overlap at least part of the outline in plan view of the downstream channel 35, as in the example illustrated in FIG. 8. This configuration readily enables bubbles to be discharged through the first downstream openings 37 to the downstream channel 35.

Third Embodiment

Figure 10:
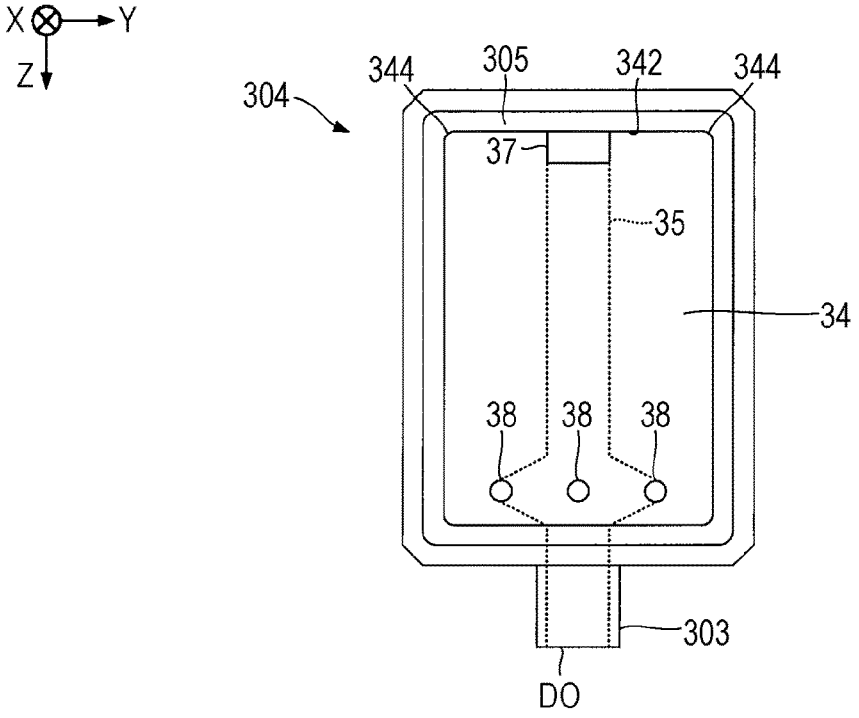
FIG. 10 is a plan view of a downstream member according to a third embodiment.

A third embodiment of the invention is described. Although a single second downstream opening 38 is exemplified in the first embodiment, two or more second downstream openings 38 are exemplified in the third embodiment. FIG. 10 is a plan view of the downstream member 304 according to the third embodiment as viewed in the X direction. The downstream compartment 34 in FIG. 10 has three second downstream openings 38. The three second downstream openings 38 are arranged in the Y direction (exemplary second direction). This arrangement enables ink to be supplied through the three second downstream openings 38 to the downstream channel 35 regardless of bubbles remaining around the first downstream opening 37 during a printing operation. In the case where two or more second downstream openings 38 are arranged, it is preferable that the total cross-sectional area of the second downstream openings 38 be smaller than the cross-sectional area of the first downstream opening 37. This configuration can make the channel resistance of the first downstream opening 37 lower than that of the second downstream openings 38 and can thus cause discharge of bubbles Bu through the first downstream opening 37 more readily than through the second downstream openings 38.

As indicated by the dotted lines in FIG. 10, a part of the downstream channel 35 may have a wider area in the Y direction, such that the outlines in plan view of the second downstream openings 38 overlap the outline in plan view of the downstream channel 35. That is, the outlines in plan view of two or more second downstream openings 38 arranged in the Y direction can also overlap at least part of the outline in plan view of the downstream channel 35. This configuration readily enables ink to be supplied through the second downstream openings 38 to the downstream channel 35 during a printing operation.

Figure 11:
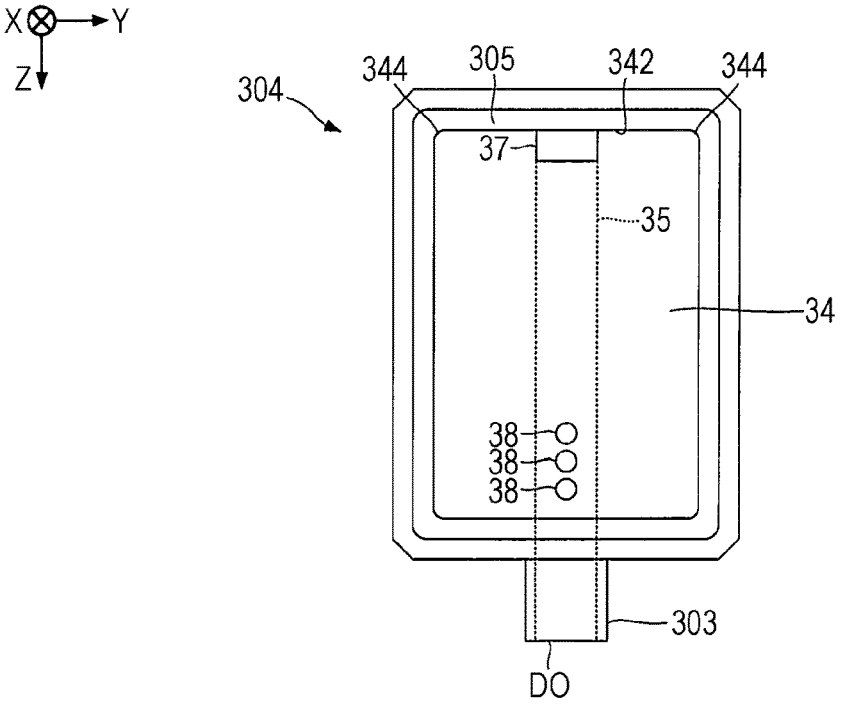
FIG. 11 is a plan view of a downstream member according to a first modification of the third embodiment.

Although the second downstream openings 38 are arranged in the Y direction in FIG. 10, this configuration should not be construed as limiting the invention. Alternatively, the second downstream openings 38 may be arranged in the Z direction. For example, according to a first modification of the third embodiment in FIG. 11, the downstream member 304 has three second downstream openings 38 arranged in the Z direction. The three second downstream openings 38 arranged in the Z direction do not require the downstream channel 35 to have a wider area portion in the Y direction. The downstream channel 35 in FIG. 11 thus has a linear shape like the downstream channel 35 in FIG. 5.

Figure 12:
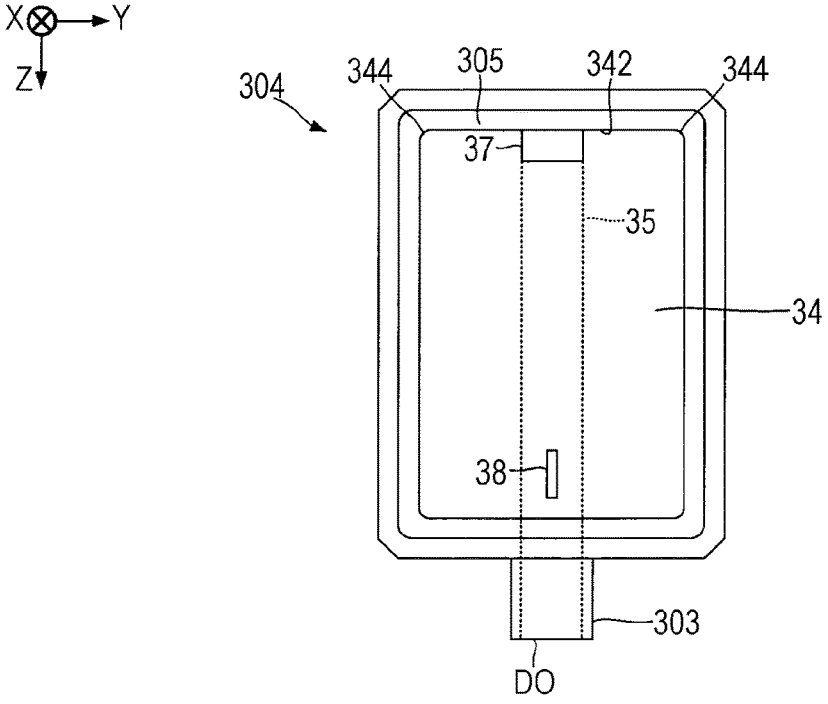
FIG. 12 is a plan view of a downstream member according to a second modification of the third embodiment.

These three second downstream openings 38 are disposed below the first downstream opening 37 in the vertical direction. The three second downstream openings 38 disposed below the first downstream opening 37 can enable ink to be supplied to the downstream channel 35, regardless of bubbles inhibiting the ink supply through the first downstream opening 37. This configuration enables sufficient ink to be supplied to the liquid ejector 22 without being affected by the remaining bubbles. Although the second downstream openings 38 are arranged in the Z direction in FIG. 11, this configuration should not be construed as limiting the invention. Alternatively, according to a second modification of the third embodiment in FIG. 12, the downstream member 304 may have a single second downstream opening 38 elongated in the Z direction.

Modifications

The above-illustrated aspects and embodiments may be modified in various manners. Some specific exemplary modifications will be described below. Any two or more of these modifications and the above embodiments may be appropriately combined with each other provided that there are no contradictions.

(1) In the above embodiments, a serial head printer in which the carriage 18 provided with the liquid ejecting head 20 thereon reciprocates in the X direction is exemplified. The invention may also be applied to a line head printer including a liquid ejecting head 20 spanning the entire width of a medium 11.

(2) In the above embodiments, the liquid ejecting head 20 is of a piezoelectric type and includes the piezoelectric elements for providing mechanical oscillation to the pressure chambers. This liquid ejecting head 20 may be replaced with a thermal-type liquid ejecting head that includes heater elements for generating heat to cause bubbles in pressure chambers.

(3) The liquid ejecting apparatus 10 illustrated in the above embodiments may be applied to various types of machines, such as facsimile and copying machines, in addition to machines dedicated to printing. It should be noted that the liquid ejecting apparatus 10 according to the invention may be used for purposes other than printing. For example, liquid ejecting apparatuses that eject solutions of color filter materials can be used in the manufacture of, for example, color filters of liquid crystal displays, organic electroluminescence (EL) displays, and field emission displays (FEDs). Liquid ejecting apparatuses that eject a solution of conductive material can be used to form wiring and electrodes of circuit boards. Furthermore, liquid ejecting apparatuses that eject a solution of bioorganic material (a type of liquid) can be used as chip manufacturing apparatuses.

The entire disclosure of Japanese Patent Application No. 2017-135308, filed Jul. 11, 2017 is expressly incorporated by reference herein.

What is claimed is:

1. A filter unit provided in a path for supplying liquid to a liquid ejector, the filter unit comprising:

an upstream compartment into which the liquid flows from an upstream channel;

a downstream compartment from which the liquid flows into a downstream channel; and a filter that serves as a partition between the upstream compartment and the downstream compartment, wherein the upstream compartment overlaps the downstream compartment in a first direction intersecting a vertical direction, and the downstream compartment has at least one first downstream opening and at least one second downstream opening in communication with the downstream channel, the second downstream opening being disposed below the first downstream opening in the vertical direction.

2. The filter unit according to claim 1, wherein the at least one first downstream opening has a channel resistance lower than a channel resistance of the at least one second downstream opening.

3. A liquid ejecting head comprising:

the filter unit according to claim 2; and a liquid ejector that ejects liquid supplied from the filter unit.

4. The filter unit according to claim 1, wherein the at least one first downstream opening adjoins an inner top surface of the downstream compartment.

5. The filter unit according to claim 4, wherein the upstream compartment has an upstream opening in communication with the upstream channel, the at least one first downstream opening is disposed above the upstream opening in the vertical direction, and the at least one second downstream opening is disposed below the upstream opening in the vertical direction.

6. A liquid ejecting head comprising:

the filter unit according to claim 5; and a liquid ejector that ejects liquid supplied from the filter unit.

7. A liquid ejecting head comprising:

the filter unit according to claim 4; and a liquid ejector that ejects liquid supplied from the filter unit.

8. The filter unit according to claim 1, wherein the at least one first downstream opening has an outline in plan view at least partially overlapping an outline in plan view of the downstream channel.

9. A liquid ejecting head comprising:

the filter unit according to claim 8; and a liquid ejector that ejects liquid supplied from the filter unit.

10. The filter unit according to claim 1, wherein the at least one first downstream opening includes a plurality of first downstream openings arranged in a row on the downstream compartment in a second direction intersecting the vertical direction.

11. The filter unit according to claim 10, wherein the downstream compartment has a rectangular shape, and at least one of the first downstream openings is disposed adjacent to a corner of the downstream compartment.

12. A liquid ejecting head comprising:

the filter unit according to claim 11; and a liquid ejector that ejects liquid supplied from the filter unit.

13. A liquid ejecting head comprising:

the filter unit according to claim 10; and a liquid ejector that ejects liquid supplied from the filter unit.

14. A liquid ejecting head comprising:

the filter unit according to claim 1; and a liquid ejector that ejects liquid supplied from the filter unit.

* * * * *